United States Patent [19]

Shannon

[11] 4,129,079

[45] Dec. 12, 1978

[54] RAILROAD CAR FOR HIGHWAY TRAILERS

[76] Inventor: Montague W. Shannon, 2121 Bragg St., Lot 1, Chamblee, Ga. 30341

[21] Appl. No.: 813,484

[22] Filed: Jul. 7, 1977

[51] Int. Cl.[2] ..... B65G 67/02

[52] U.S. Cl. ..... 105/368 B; 214/38 A

[58] Field of Search ..... 214/38 A; 105/368 B, 105/455; 104/44, 45, 35

[56] References Cited

U.S. PATENT DOCUMENTS

| | | | |
|---|---|---|---|
| 2,883,945 | 4/1959 | Walker | 105/368 B |
| 3,204,579 | 9/1965 | Burns et al. | 105/368 B |
| 3,352,438 | 11/1967 | Davidson | 105/368 B |
| 3,370,550 | 2/1968 | Gutridge et al. | 105/366 R |
| 3,581,918 | 6/1971 | Fujioka | 214/38 A |
| 3,635,362 | 1/1972 | Pratt | 214/38 A |

*Primary Examiner*—Lawrence J. Oresky

[57] ABSTRACT

A railroad car has supported on its frame a trailer-handling rack construction including a pair of runners adapted to receive the tandem or highway wheels of a semitrailer. The runners are turnable laterally and shiftable longitudinally of the car. A trailer is loaded onto the car from a platform at the side of the car by action only of a highway tractor or railroad yard tractor. As the trailer is backed onto the car, the highway wheels of the trailer reverse roll onto the pair of runners and to a position approximately at the transverse center of the car, the highway wheels are then restrained to the runners. Backing the trailer is continued while tractor-maneuvering the trailer forward portion to the transverse center of the car. Simultaneously, the trailer rearward portion is conveyed on the pair of runners, the runners turning laterally and shifting longitudinally of the car. In loading the trailer on the car, the forward and rearward portions of the trailer are conveyed oppositely laterally in skewing movements and the trailer moved to a piggyback disposition on the car.

9 Claims, 20 Drawing Figures

FIG. 1
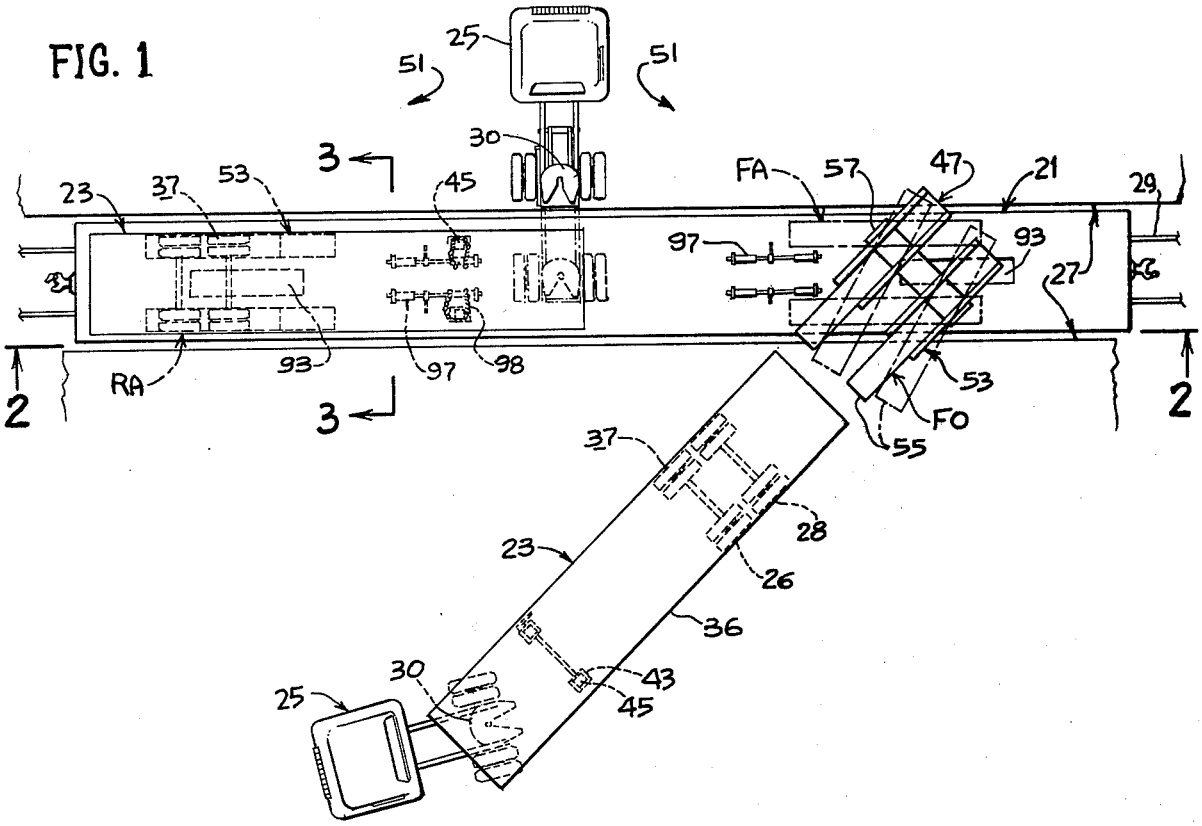
FIG. 2
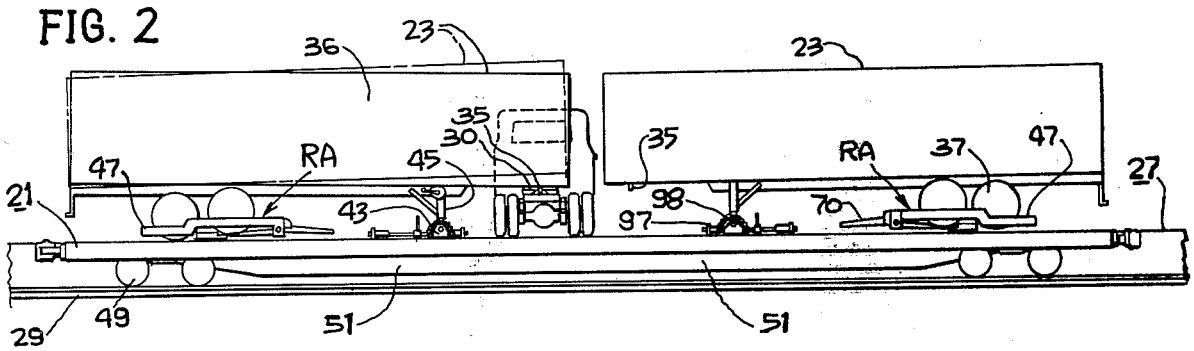
FIG. 3
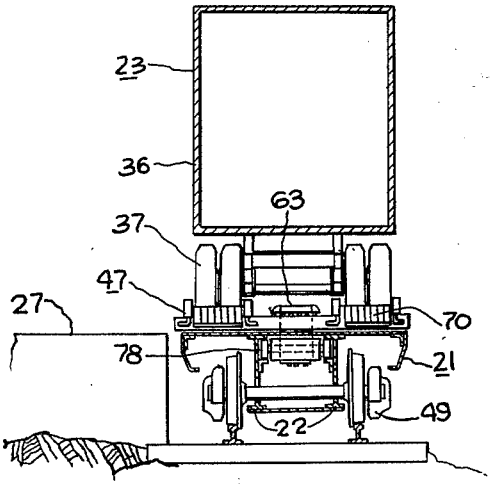
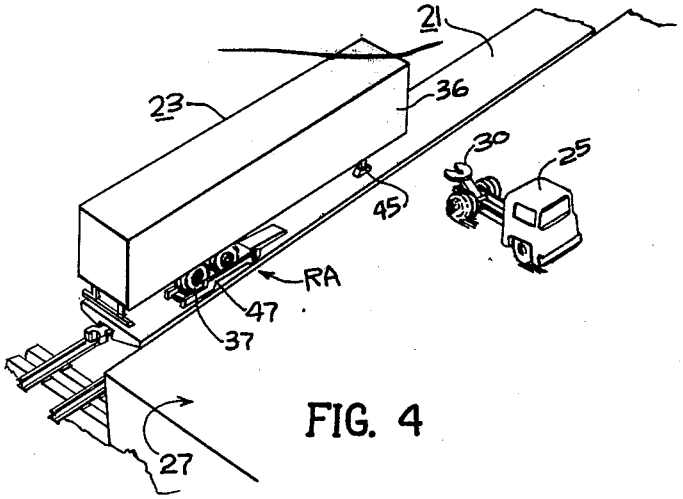
FIG. 4

FIG. 5
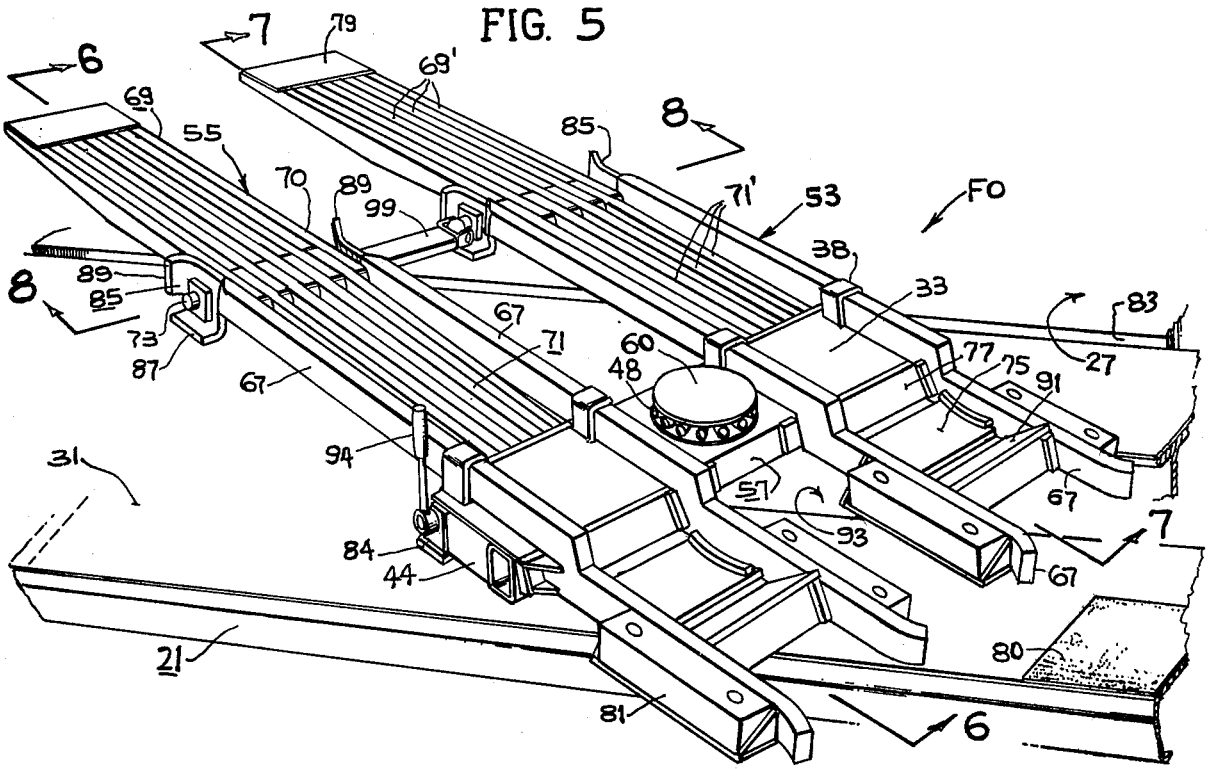
FIG. 6
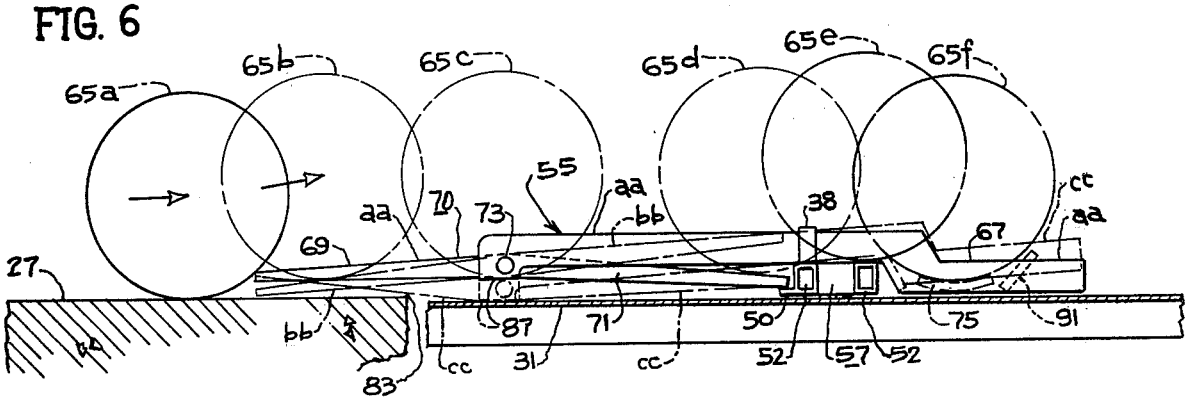
FIG. 7
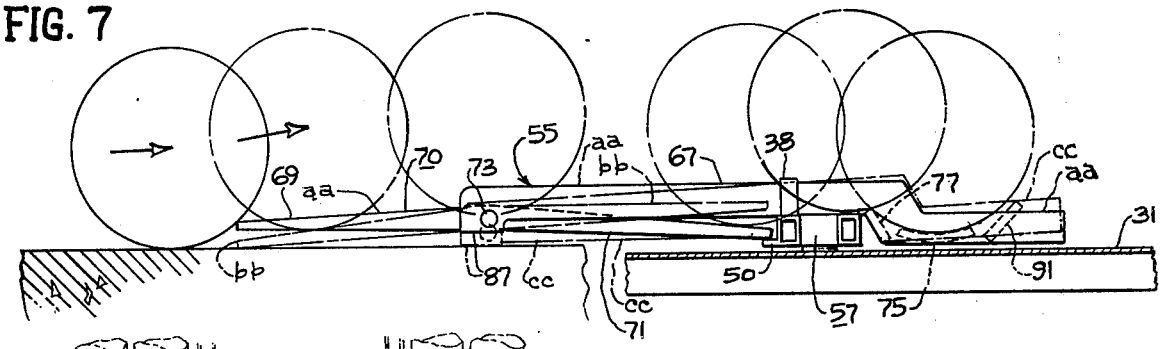
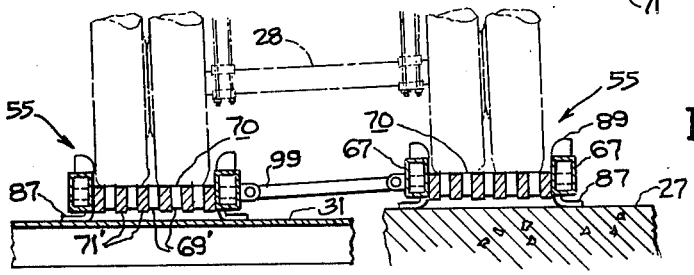
FIG. 8

FIG. 12
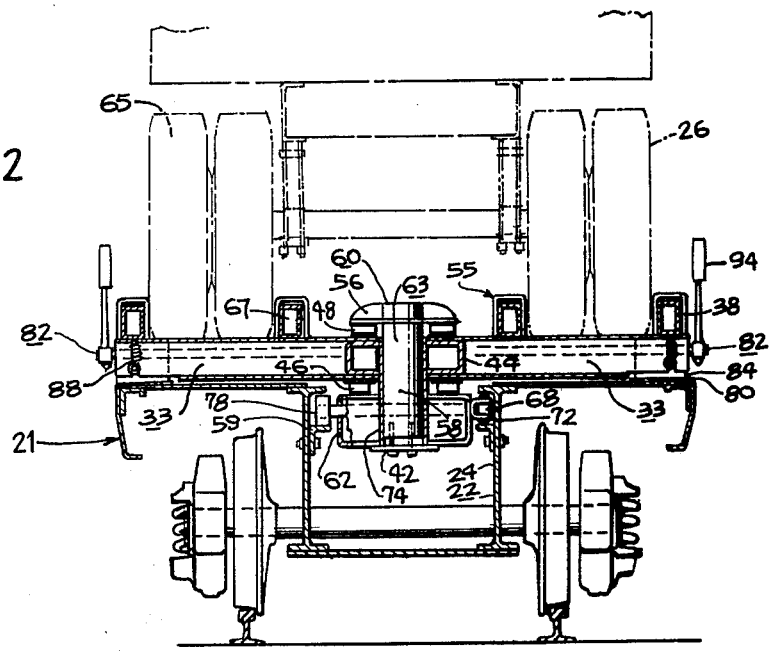
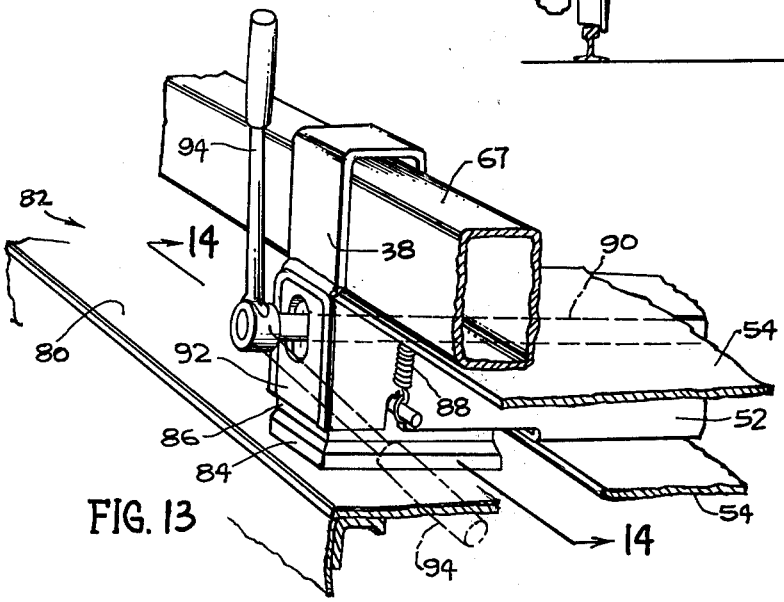
FIG. 13
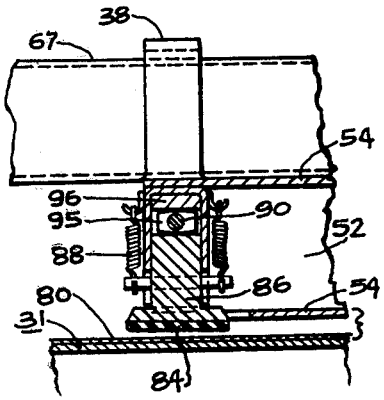
FIG. 14
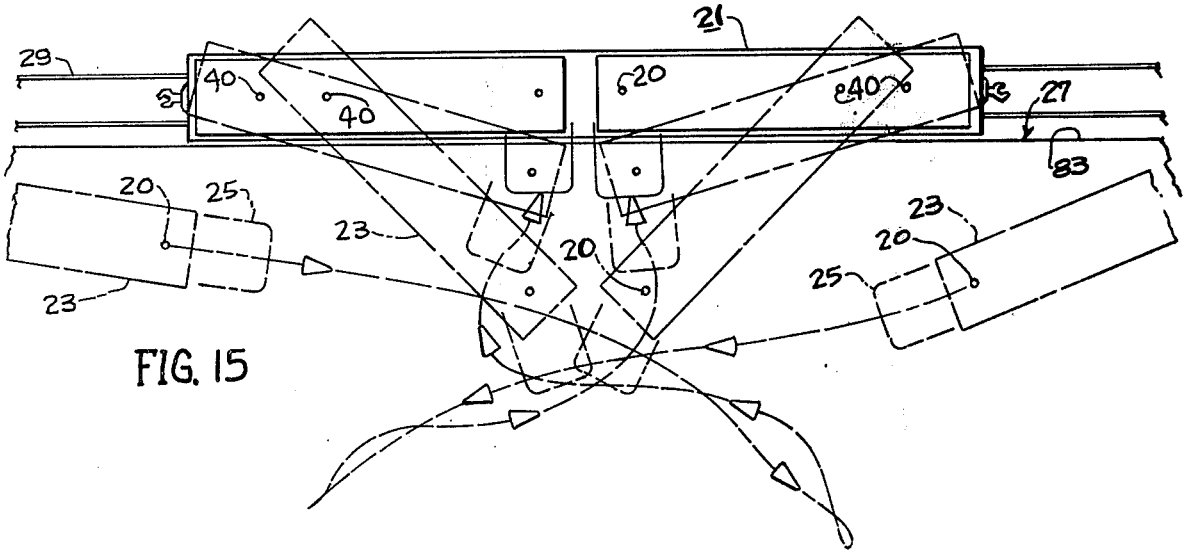
FIG. 15

FIG. 16A
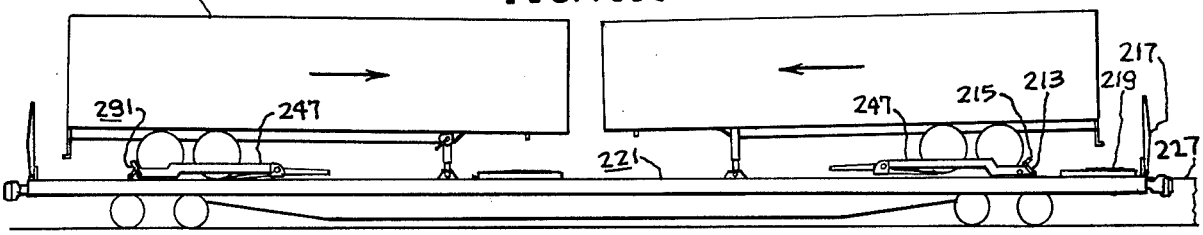
FIG. 16B
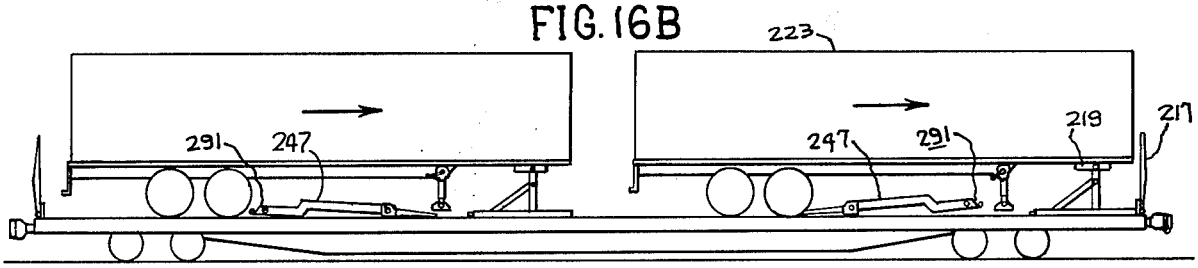
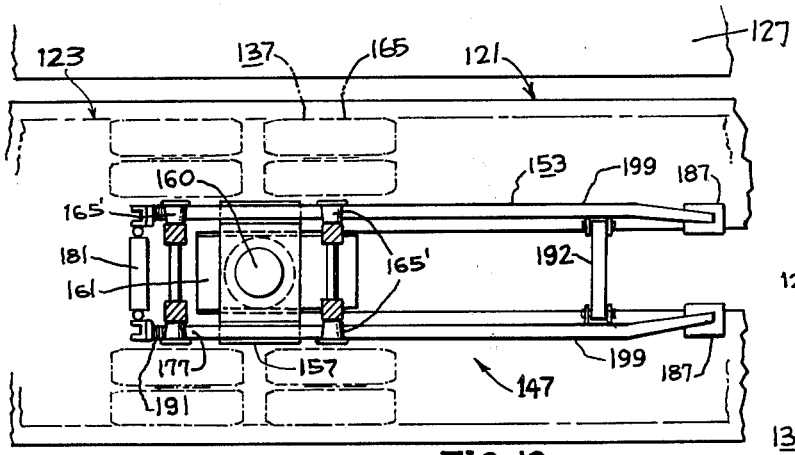
FIG. 18
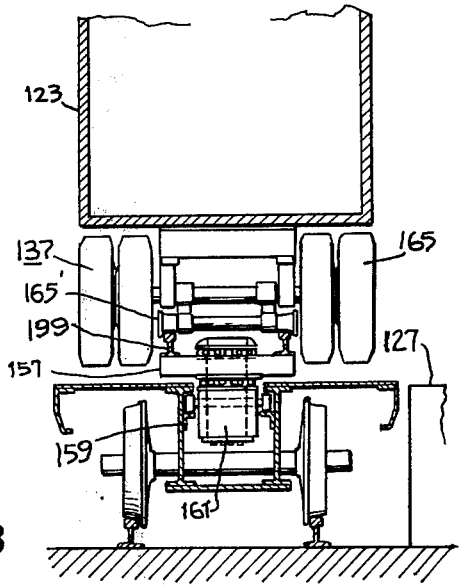
FIG. 19
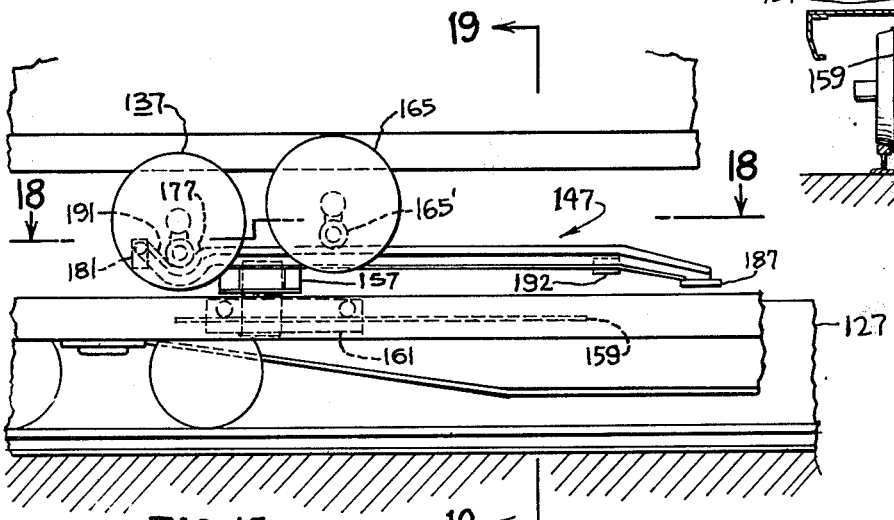
FIG. 17

RAILROAD CAR FOR HIGHWAY TRAILERS

BACKGROUND OF THE INVENTION

1. Field of the Invention

Relates to railroad-highway transport apparatus generally and particularily to trailer handling, TOFC — trailer-on-flatcar transportation. This invention is an improvement on my earlier inventions, U.S. Pat. No. 3,610,169 titled Road-Rail Transport Apparatus, and U.S. Pat. No. 3,370,551 titled Railroad-Highway Transport Apparatus and Method.

2. Description of the Prior Art

In present practice, the typical TOFC car is adapted for use in transporting two highway semitrailers and is provided with a forward and a rearward trailer hitch for engaging the kingpin of the trailers. The trailer loading/unloading procedure and use of the trailer hitches may be considered to be car-side loading and car-end loading: car-side loading is generally done in high-volume TOFC terminals equipped with a mobile crane or heavy duty lift truck, and the trailers are bodily lifted and manipulated in loading and unloading the cars.

In the car-end loading/unloading procedure, a string of cars is backed against a ramp with all the cars facing the same direction, the car-mounted bridge plates are folded down between the cars, and the trailers, each in succession are maneuvered by a tractor onto or off the cars. The trailer hitches are raised for anchoring the kingpins of the trailers or retracted for permitting passage of the trailers and tractor on the string of cars.

There are many problems attendant existing trailer-handling practices: In the typical TOFC terminal, using car-side loading/unloading procedure, the operation of the mobile crane or lift truck equipment is paramount. In certain TOFC terminal locations, a single lift truck or crane may handle each trailer. The cost of such heavy-lifting equipment is high, it is generally captive equipment, its design and function is limited, and when it breaks down or malfunctions, a TOFC operation is greatly hampered.

In the existing car-end loading/unloading procedure, marshalling or turning the cars so that they face the same direction is costly in time, labor and equipment use. Considerable skill on the part of a tractor driver is needed for backing a loaded tractor-trailer rig up a ramp and along the elevated decks and bridges of a string of cars. At the loading of each trailer on a car, the trailer hitch is retracted, the trailer is backed over the hitch, and the hitch is then raised and latched to the kingpin. This procedure is carried out for each trailer and each car successively — a rather slow, arduous operation.

The manipulation and proper latching of the trailer hitches requires considerable practice and effort. Many hitches are raised and retracted by use of an electric-powered rotary tool. Such tools are rather awkward and inconvenient to use and require an electric current supply line. It is not unusual for a hitch to become inoperative or malfunction to the extent that it cannot be used. In such instances, a car may carry only a half load or only one trailer, resulting in wasted cargo space and inefficiency.

There is the tendency of the trailers to rock laterally, sometimes violently, while they are being transported on a car. This places heavy strain forces on the trailer hitch and kingpin area of a trailer and can shift or damage the trailer cargo. A trailer manufactured for TOFC service generally is provided with extra strong or reinforced construction at the kingpin area, resulting in increased cost and weight of the trailer.

SUMMARY OF THE INVENTION

An object of the invention is to provide an alternative to the present practice of lifting and manipulating trailers with crane and lift truck — to reduce the high cost of installation and operation of such equipment, and generally to improve efficiency of a TOFC terminal.

A single railroad car of the invention or a string of such cars can readily be loaded with highway trailers from either or both sides of the car or cars. In a TOFC terminal operation, several tractors can simultaneously be used in loading or unloading a string of cars, alleviating terminal congestion, improving dispatch and distribution of trailers.

Side loading/unloading of the car of the invention can be done at generally any railroad siding or location having a platform for accommodating a tractor-trailer combination. A regular highway tractor, equipped with or without a hydraulic fifth wheel, can be used for maneuvering a trailer in the loading/unloading procedure. The same tractor used to load or unload a car can also be used for highway hauling the trailer, promoting efficient use of labor and equipment.

Car loading/unloading can be performed quickly, easily and safely, and if necessary, can be performed by labor and attendance only by the tractor driver. The rather simple, direct loading/unloading procedure permits a consignee or a non-railroad entity to be responsible for loading or unloading a car.

The side loading procedure of the invention permits a particular trailer of a particular car to be loaded or unloaded without change or movement to other trailers or cars.

The trailers each are four-point-supported firmly on the car during transit, resulting in less rocking of the trailers, less damage to equipment and cargo. In loading/unloading, the trailers are handled smoothly, without jolting the trailer or cargo. The firm mounting of the trailer on the car allows increased train speeds, better scheduling of shipments.

In railroad travel, the trailer front and kingpin areas are free and unstressed; the buff and draft, and lateral movement forces are dispersed and transmitted mainly to the running gear parts of the trailer — the stronger parts of a trailer. The invention permits highway trailers for railroad shipment to be constructed without heavy duty or reinforced kingpin structure, reducing the cost and weight of such trailers.

The trailer-loading rack construction of the car is mechanically simple, strong and reliable, it does not require electric power or any powered devices for use other than a trailer-maneuvering tractor vehicle.

The invention favors TOFC conveyance of light-weight, short-haul loads, competitive with direct haul motor carrier operations. Application of the invention favors lower shipping costs — faster, more flexible routing and reliable scheduling of trailer shipments, more comprehensive use of equipment.

The invention favors evolutionary development of TOFC transportation; the equipment and operating procedures are compatible with existing equipment and procedures.

BRIEF DESCRIPTION OF THE DRAWINGS

FIG. 1 is a top plan view illustrating a railroad car of the invention being loaded with two trailers and illustrating operation of the trailer-handling rack construction of the car;

FIG. 2 is a side elevational view taken on the line 2—2 of FIG. 1, but showing the loading procedure completed;

FIG. 3 is a sectional view taken on the line 3—3 of FIG. 1, but showing a loading platform only on one side of the car;

FIG. 4 is a perspective view of the car supporting a trailer at a platform location, and showing also a highway tractor vehicle;

FIG. 5 illustrates the railroad car alongside a loading platform and with the trailer rack superstructure being arranged for receiving the running gear of a trailer;

FIGS. 6 and 7, taken respectively on the lines 6—6 and 7—7 of FIG. 5, show in longitudinal section the left and right runner assemblies of the rack superstructure, and show schematically the relative movements of the runner assemblies as a wheeled axle of a trailer rolls into place on the superstructure;

FIG. 8 is a sectional view, taken on the line 8—8 of FIG. 5, of the left and right runner assemblies, and schematically showing a wheeled axle of a trailer supported on the runner assemblies;

FIG. 12 is a sectional view, taken on the line 12—12 of FIG. 10;

FIG. 13 is a perspective view of a mechanism for anchoring the trailer rack superstructure to the car deck;

FIG. 14 is a view taken on the line 14—14 of FIG. 13;

FIG. 15 is a plan view of the railroad car at a trailer-loading location, illustrating movement of two tractor-trailer rigs in loading the car;

FIGS. 16A and 16B illustrate another embodiment of the invention — a combination car, having trailer-handling rack constructions and conventional car-mounted trailer hitches; and, FIGS. 17, 18 and 19 illustrate another embodiment.

DESCRIPTION OF THE PREFERRED EMBODIMENT

Figure 9:
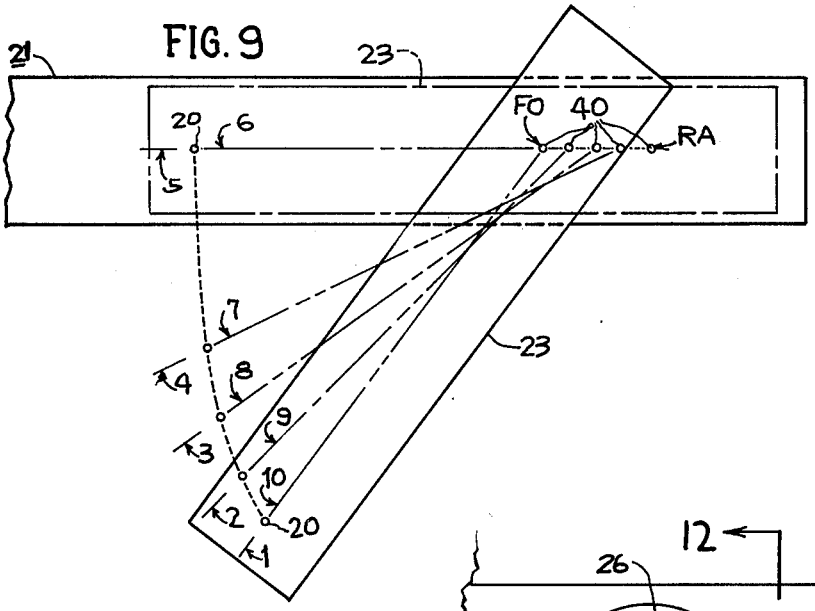
FIG. 9 schematically illustrates correlated movements of the forward and the rearward support points of a trailer during loading or unloading.

FIGS. 1, 2 and 4 provide a general view of the preferred embodiment, including a railroad car 21 supported on a track 29, a semitrailer 23 and truck-tractor vehicle 25, and platform structure 27 disposed alongside the track 29 and car 21. The platform structure 27 is generally coplanar with the car deck 31, of size and construction suitable for supporting the tractor-trailer combination 25-23 and for tractor-maneuvering the trailer thereon.

In the following description, the semitrailer 23 will be referred to simply as trailer 23, for reason of clarification and in accord with the name such vehicle is most generally known. Also, for the same reason, the truck-tractor 25 will be referred to simply as tractor 25.

The trailer 23 is of typical highway trailer configuration and includes load bearing structure 36, a highway wheel assembly 37 having forward and rearward wheeled axles 26 and 28, and landing gear structure having landing pads 43 attached to leg members 45, connected to manually operative mechanism for extending or retracting the leg members. The tractor 25 is of single-drive-axle highway tractor form and includes a fifth wheel 30 for latching to the kingpin 35 of the trailer. The fifth wheel 30 preferably is hyraulically operative for power-lifting and lowering the front portion of the trailer.

The railroad car is symetrical in form and of like construction oppositely of the car center. Trailer-handling rack constructions 47, 47 are provided for receiving and supporting the highway wheel assemblies 37, 37 respectively of the trailers 23, 23. The rack constructions 47, 47 are confrontingly arranged equidistantly of the car center and generally superjacently of the car trucks 49, 49. During railroad transit, the trailers 23, 23 are carried on the car in front to front relation with the wheel assembly 37 of each trailer supported on a rack construction 47 of the car, and the landing gear members 43, 43 of the trailer supported on the car deck — see FIG. 2.

For purposes of clarity in description, car 21 is considered to be disposed in car sections 51, 51, oppositely of the car center, with each section 51 having a rack construction 47 adapted for handling a trailer 23. Thus, in the description immediately following, that section of the car appearing on the right in FIG. 1 will be described in detail and in conjunction with the trailer 23 and tractor 25 appearing on the right. Additionally, the rack construction 47 of the car section is considered to be facing the center of the car and as having forward structure and direction.

Figure 11:
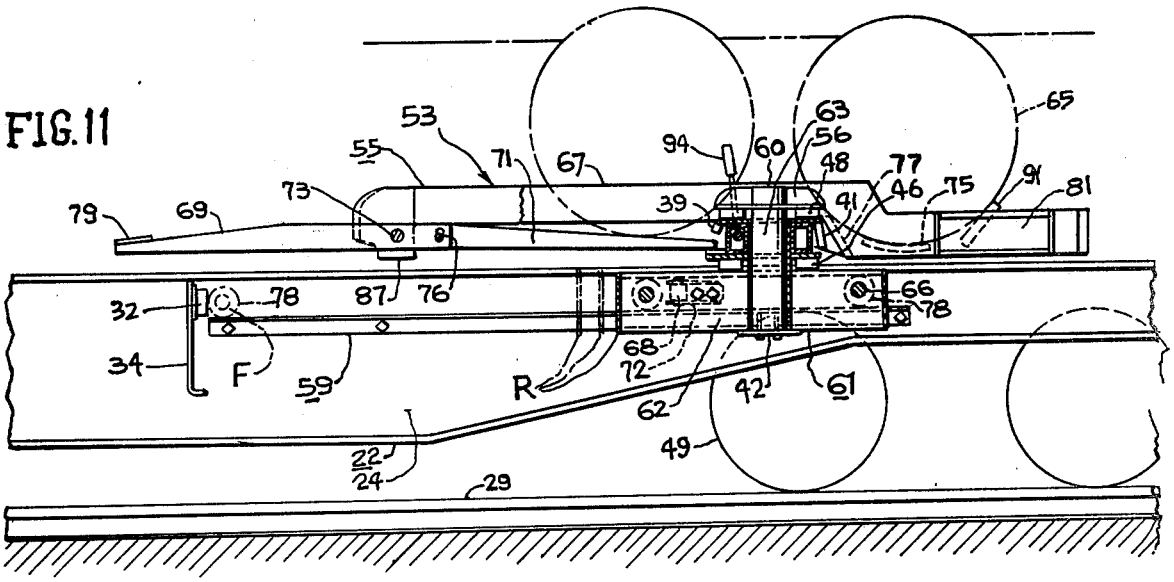
FIG. 11 is a longitudinal bisectional view of the structure of FIG. 10, but schematically showing the trailer wheel assembly.

The rack construction 47 includes superstructure 53 including left and right runner assemblies 55, 55 and bolster structure 57; a carriage and track arrangement 61, 59; and, superstructure mounting 63 turnably mounting the superstructure 53 on the carriage and track arrangement 61, 59 — see FIGS. 5, 8 and 11. The superstructure, with the runner assemblies 55, 55 is turnable laterally and shiftable longitudinally of the car.

The runner assemblies 55, 55 are parallel arranged and act as runner means respectively for the left and right dual wheel members 65, 65 of the trailer running gear 37. The assemblies 55, 55 extend generally horizontal, with the intermediate portions thereof resting on the bolster 57 and with longitudinally opposite portions extending cantilever like forward and rearward of the bolster.

The runner assemblies 55, 55 are alike and the following description of the left assembly will describe also the right assembly: The left assembly 55, as best seen in FIGS. 5, 6, 8 and 10, includes a pair of frame members 67, 67 supported on and extending oppositely of the bolster 57; treadway structure 70 tiltably supported by a shaft 73 supported on the forward ends of frame members 67, 67; and a crosspiece 75, loosely connecting and spanning the rearward projecting portions of the frame members.

The treadway 70 is of openwork construction, formed basically of parallel-arranged extension members 69′ and 71′, alternately arranged and extending oppositely of shaft 73, forming respectively forward and rearward treadway extensions 69 and 71. The rearward extension 71 is heavier than the forward extension, causing it to move downward and the extension 69 to move upward — see FIG. 10. A flange 50 is fastened on the lower forward edge of bolster 57. Flange 50 normally engages the rearward edge of treadway extension 71, supporting the treadway extension and acting as stop means stopping the rearward tilting movement of treadway 70. Shaft 73, in addition to providing pivotal support mounting for the treadway, also provides pivotal joint connection permitting hingelike, angular movement between the forward and rearward treadway extensions 69 and 71 — see FIG. 6. The gravity-urged downward inclinations of the treadway extensions 69, 71 oppositely of shaft 73 are limited by check means including a check rod 76 extending through slotted aperatures formed respectively in the treadway members 69', 71'. A plate assembly 79 at the distal end of the runner assembly loosely connects together the forward ends of the treadway members 69'.

A wheel chock member 91 is disposed directly rearward of crosspiece 75 providing means for limiting the backward travel of the trailer wheel assembly 37 relative to the runner assembly 55, during the trailer loading procedure. A detent member 77 is disposed directly forward of crosspiece 75, providing means for detent-holding wheel assembly 37 relative to runner assembly 55, during forward travel of the assembly 37, during the trailer unloading procedure. The chock and detent members 91, 77 provide means for controlling movement of assembly 37 relative to the runner assembly respectively during the loading and unloading of the trailer.

Support members 85, 85 are fastened to the forward ends of the runner assembly frame members 67, 67, supporting the opposite ends of treadway shaft 73. The support members 85, 85 each are provided with forward and downward directed portions, defining respectively divergingly formed trailer wheel guide structure 89, 89 and foot-like frame pads 87, 87 — FIG. 5. Counterweight bars 81, 81 are fastened respectively to the frame members 67, 67, rearward of bolster 57, providing weight means offsetting the weight of treadway 70 and the forwardly projecting structure of the runner assembly.

The following describes certain actions of the left runner assembly as a trailer wheel 65 rolls from platform 27 to a stopped disposition supported between the detent and chock members 77, 91 — illustrated in the wheel locations 65*a* to 65*f* in FIG. 6: In moving from 65*a* to 65*b*, the wheel rolls onto and moves the forward end of treadway extension 69 downward against the platform, tilting the treadway and lifting extension 71 from its seat on flange 50 of bolster 57 — see the treadway position indicated bb in FIG. 6. As the wheel rolls further and toward the location 65*c*, the trailer weight, pressing on the treadway extension 69, carries the forward portions of frame members 67, 67 downward, seating the frame pads 87, 87 on the car deck, tilting the frame members across the forward edge of the bolster and raising the rearward counterweighted portion of the runner assembly. Simultaneously, shaft 73 is carried downward, causing the rearward end of treadway extension 71 to reseat on the bolster flange 50, and the extension 69 to engage the platform edge 83 and be inclined upward — see the frame and treadway positions indicated cc in FIG. 6. Further reverse roll movement of the wheel, through the wheel locations 65*d* and 65*e*, and across bolster 57 to the stopped position 65*f*, returns the runner assembly 55 to the position aa in FIG. 6.

The bolster 57 is substantially low, rectangular in cross section and of length corresponding generally with the width of the car deck. A pair of frame members 52, 52 form the main support structure of the bolster and are connected in parallel relation by upper and lower tie plates 54, 54 and crossmembers 44, 44. The bolster and the left and right runner assemblies form the superstructure 53 of the rack construction 47, formed substantially by that structure disposed above the level of the car deck.

The pair of runner assemblies rest respectively on the left and right projections 33, 33 of the bolster 57 and are secured against lateral and longitudinal displacement respectively by curb members 38 and forward and rearward lug members 39, 41. The curb members 38 each are inverted U-shape and fastened respectively on the forward upper portions of the bolster, loosely securing the runner frame members 67 to the bolster. The lug members 39, 41 are fixed dependingly to the runner frame members 67, contiguous respectively to the forward and rearward edge portions of the bolster — see FIG. 10. A connecting member 99 — FIG. 5 — is articulately connected at opposite end portions thereof to the treadway shafts 73, 73, providing flexible link means assisting in maintaining the assemblies 55, 55 in parallel relation.

The runner assemblies 55, 55 are generally independently operable and as a wheeled axle of a trailer rolls onto or off the runner assemblies, at a given moment, the assembly 55 supporting one wheel of an axle will be in one configuration and the assembly 55 supporting the other wheel of the axle will be in another configuration — compare FIGS. 6 and 7. The independently operable actions of the assemblies 55 and 55 are brought about mainly because of a difference in height of a car deck and a platform, and because of the oblique arrangement of the runner assemblies relative to the car and platform. As will be noted in viewing FIGS. 5, 6 and 7, the frame pads 87, 87 of the right runner assembly seat on the platform, and the pads 87, 87 of the left runner assembly seat on the car deck as the trailer assembly 37 rolls onto or off the rack superstructure; when the runner assemblies 55, 55 and the runner frame members 67 move downward, seating the pads 87, the turning, shifting actions of the rack superstructure are prevented. As the trailer wheel assembly moves rearward on the runner assemblies 55, 55 and to the chocked position, the frame members 67 return to horizontal, permitting turning, shifting movement of the superstructure. The runner assemblies 55, 55 are disposed horizontal prior to receiving the trailer wheel assembly and after the wheel assembly is received and supported in a stopped disposition on the rack superstructure.

The carriage 61 includes oppositely arranged frame side members 62, 62 connected by frame end members 64, 64. The carriage frame is mounted on wheels 78, 78 arranged in pairs respectively on opposite ends of axles 66, 66. The wheels 78 are flat-faced and run on the flat upper surfaces of rails 59, 59 secured in corresponding relation on the web portions 24, 24 of the car frame members 22, 22. The carriage 61 is moveable forward or rearward on the track rails, between a full forward stopped position, indicated F, and infinitely variable rearward locations, indicated R — see FIG. 11. A stop member 32, fastened to a tie member 34 disposed between the frame members 22, 22, provides stop means for limiting the forward movement of the carriage. Open space 93 is provided in the car deck and between the frame members 22, 22 permitting free movement of the carriage longitudinally of the car. Guide rollers 68, 68 are supported on the carriage frame; brackets 72, 72 fastened to the frame side members 62, 62, support the rollers 68, 68 on vertical axes, on opposite sides of the carriage. The rollers engage the web portions 24, 24 of the frame members and guideingly constrain the carriage against lateral displacement.

The superstructure mounting means 63 turnably supports the superstructure 53 on carriage 61 and includes, a center member 60 having a cylinderical body portion 58 and a radially expanded head portion 56, a cylinderical casing 74 secured vertically in the carriage frame, and upper and lower thrust bearing assemblies 48, 46 disposed above and below the bolster — see FIG. 12. The center member 60 is secured on the carriage 61 with the cylinderical body portion 58 extending downward through the upper thrust bearing assembly 48, through an opening in the center of the bolster, through the lower thrust bearing assembly 46, and downward into the cylinderical interior of the carriage-mounted casing 74. An adjustment arrangement 42, disposed subjacently of center member 60, provides means for tensioning the center member downward and adjustment-loading the bearing assemblies 48, 46. The adjustment arrangement 42 provides means for maintaining the bolster 57 radially perpendicular to the center member and parallel with the railroad car deck.

Figure 10:
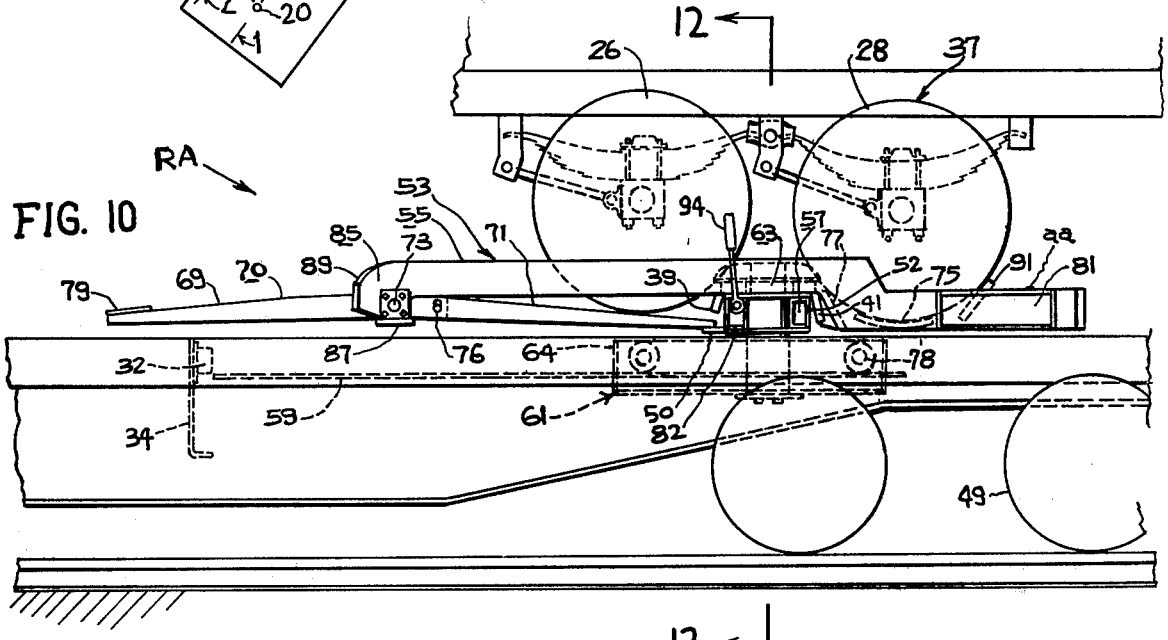
FIG. 10 is a side view of that part of the railroad car including the rack construction, and showing the wheel assembly of a trailer supported thereon.

The superstructure-carriage 53, 61 is moveable by traction of tractor 25 from an FO — forward oblique configuration, to an RA — rearward aligned configuration, in loading the trailer; and, oppositely of this in the trailer unloading procedure — compare FIGS. 5 and 10. In the RA configuration, the superstructure-carriage 53–61 is located rearward, with the superstructure in corresponding alignment with the car, supporting the trailer in corresponding relation with the car; in the FO configuration, the superstructure-carriage 53–61 is stopped by member 32 in a full forward position with the superstructure 53 disposed obliquely of the car. The superstructure and carriage move to the RA configuration during the final movement of the trailer onto the car and are disposed thus during rail transit; the superstructure and carriage are in the FO configuration at the beginning of the trailer loading and the ending of the trailer unloading procedures. A rearward location of the superstructure-carriage while in the RA configuration, and likewise a position R of the carriage, is determined mainly by the location of the wheel assembly (37) relative to the kingpin (35) in a particular trailer. This distance, and thus the carriage location R, may vary from one trailer to another, or be variable in a single trailer having a wheel assembly adjustable lengthwise of the trailer.

Forward and rearward turn-support points 20 and 40 of a trailer 23 are schematically illustrated in FIGS. 9 and 15. The rearward support point 40 indicates the center area-of-support of the trailer running gear 37; the forward support point 20 indicates the kingpin area of the trailer, and that area turn-support-engaging the fifth wheel 30 of a tractor. FIG. 9 schematically illustrates correlated movements of the support points 20, 40 and the forward or rearward movement of support point 40 responsive to the tractor-manipulation of the support point 20 toward or away from the car. The loading of the trailer is indicated by numerals 1, 2, 3, 4 and 5; the unloading of the trailer by numerals 6, 7, 8, 9 and 10. It will be noted that when the trailer is in the position 5–6, the superstructure-carriage 53, 61 will be in the rearward aligned — RA configuration; and, when the trailer is in the position 1–10, the superstructure-carriage will be in the forward oblique — FO configuration. The trailer positions 2–9, 3–8 and 4–7 do not indicate positions of the trailer, but are shown for illustrating trailer-movement phases or progressive movement of a trailer between the positions 5–6 and 1–10, in a trailer loading or unloading operation.

Anchoring means including hand-operative mechanisms 82, 82, preferably is provided for holding carriage 61 at a particular location R, and for securing the rack superstructure and trailer against longitudinal displacement relative to the car deck during railroad travel — see FIGS. 10–12. The anchor mechanisms 82, 82 are arranged respectively at opposite end portions of bolster 57, and are operative along opposite edge areas 80, 80 of the car deck. Each mechanism 82 includes a shoe 84, moveable between a lowered active configuration engaging a car deck portion 80, and a raised inactive configuration. The deck areas 80, 80 preferably are surfaced with granular material for high-friction contact with shoe members 84, 84. A shaft 90 connects the mechanisms 82, 82, providing corresponding movement of the shoe members between active and inactive configuration.

The anchor mechanisms 82, 82 are alike, and the following description of the left mechanism will describe also the right mechanism: The mechanism 82 includes a dog member 86 freely received in the left portion of the forward frame member 52 of the bolster 57. The shoe 84 is of resilient material and fastened to the base portion of the dog member. A cam 95, generally elliptical in cross section, is fitted on shaft 90, arranged for engagement with the upper surface of the dog member. A purchase bar 96 is secured in the upper interior of frame member 52, having an undersurface disposed for engagement with cam 95. Retract springs 88, 88, disposed on opposite sides of frame member 52, urge the dog member upward against cam 96 and yieldably lift shoe 84 from the car deck. A bearing piece 92 is fastened in the end of bolster 52, having a slotted opening providing bearing structure for shaft 90. Turning the shaft so that cam 95 is arranged vertically, moves shoe 84 downward and against the car deck, placing the mechanism 82 in an active configuration. Turning the shaft so that the cam member is arranged horizontally, releases the shoe and places the mechanism in an inactive configuration. Each mechanism 82 includes a hand lever 94 fastened to shaft 90 for selectively arranging the mechanisms 82, 82 active or inactive.

A pair of chain assemblies 97, 97 including chain members 98, 98 are provided for safety-securing the landing gear leg members 45, 45 of a trailer during railroad transit — FIGS. 1 and 2. The chain assemblies 97, 97 may also be used for holding the rack superstructure in an FA, lodged configuration when the rack construction 47 is not in use and during travel of the car.

In describing the use of the rack construction 47 of the railroad car, it is presupposed that the car is spotted at a platform 27 with the superstructure-carriage 53–61 arranged in the FA configuration; that a tractor-trailer combination 25–23 is supported on the platform; that the trailer 23 is a tandem-axle type having forward and rearward wheeled axles 26, 28; and, that tractor 25 is equipped with a hydraulic-powered fifth wheel 30 elevatingly supporting the front of the trailer.

In use, in loading the trailer on the car, the rack superstructure 53 is manually pivoted on the center member 60, to an FO configuration arranging the distal end portions 79, 79 of the runner assemblies 55, 55 over the platform and the frame pads 87 of the runner assemblies over respectively car deck 31 and platform 27 — FIGS. 1 and 5. The tractor-trailer rig 25–23 is maneuvered as illustrated in FIG. 15 and to a disposition as shown in FIG. 1. The tractor-trailer rig is reversed, rolling the trailer wheel assembly 37 onto the runner assemblies 55, 55, bearing the treadways 70, 70 downward and seating the frame pads 87 respectively on the car deck and platform — the frame and treadway positions cc in FIGS. 6 and 7. Continuing reverse movement of the trailer, moves the wheeled axle 28 across the bolster and to a position seating the wheels 65, 65 on crosspieces 75 between the detent and chock members 77, 91 — FIG. 10. As the wheeled axle 28 moves across the bolster, the runner assemblies 55, 55 return to horizontal positions, lifting the treadway frame pads 87 from the car deck and platform and supporting the superstructure on the center member 60 — see the configuration aa in FIGS. 6 and 7 and the trailer position 1 (one) in FIG. 9.

The lifting of frame pads 87, 87, releases the rack superstructure, and with continuing reverse movement of the tractor, the superstructure-carriage is conveyed rearward on track 59, carrying the trailer rear portion laterally and rearwardly. Simultaneously, the tractor is reversed progressively angular to the trailer, maneuvering the trailer front toward the car, and the tractor rear wheels roll from the platform onto the car deck. The turning, shifting actions of the rack superstructure-carriage 53–61 gradually slow and stop in RA configuration as the trailer support point 20 is carried to the transverse center of the car — FIGS. 9 and 15. The tractor fifth wheel 30 is lowered, lowering the trailer landing gear pads 43, 43 to seat on the car deck. The fifth wheel in unlatched and the tractor driven onto the platform. The trailer landing gear leg members 45, 45 are safety-secured by check chains 98, 98 and the rack anchor mechanisms 82, 82 are manipulated active, engaging the shoe members 84, 84 with the car deck.

When a tandem-axled trailer is loaded on the car, the load of the tandem is generally centered and balanced forward and rearward of bolster 57 with the axles 26 and 28 disposed generally symetrical of the bolster. A single axle trailer is loaded on the car in substantially the same manner as the tandem axle trailer. It will be noted, however, that when the wheeled axle of a single axle trailer is seated on the crosspieces 75, 75, the curb members 38 check the backward tilting of the assemblies 55, 55, maintaining the assemblies substantially horizontal.

If the trailer is of the type having a longitudinally adjustable wheel assembly, the assembly may be adjusted full forward prior to loading, thus shortening the wheelbase and increasing maneuverability of the tractor-trailer rig. Also, if the tractor (25) is of tandem or double-drive-axle form, the steering-turn radius is restricted and the tractor may not readily be maneuvered in backing the trailer onto the car. In such instance, the tractor driver may jockey the tractor-trailer back and forth, to turn the tractor and properly direct the front of the trailer; with the wheel assembly 37 in a stopped position on the rack superstructure, the trailer and superstructure-carriage may be moved back and forth on track 59 while maneuvering the tractor and placing the trailer.

In unloading a trailer from the car, the check chain assemblies 97, 97 and anchor mechanisms 82, 82 are released. The tractor 25 is reversed, rolling the tractor rear wheels onto the car deck, and the fifth wheel 30 is latched to the trailer kingpin. The trailer front is lifted, lifting the landing gear clear of the car deck. The tractor is then driven onto the platform, generally obliquely of the car and in a direction away from the trailer. The trailer wheel assembly 37, detent-positioned on the rack superstructure, moves the superstructure progressively forward and obliquely of the car. As the superstructure-carriage stops in the FO configuration, continuing movement of the tractor rolls the wheeled axle 28 out of the detent-stopped position, over detent members 77, 77 and across the bolster. The weight of the trailer tilts the assemblies 55, 55 downward, seating the pads 87 on the car deck and platform, permitting the trailer wheel assembly 37 to roll along the treadways 70, 70, off the distal ends of the runner assemblies and onto the platform. As the wheel assembly rolls off the treadway extensions 69, 69, the runner assemblies return to horizontal positions. The rack superstructure may then be turned to an inoperative FA disposition and lodged thus with the check chain assemblies.

FIGS. 16A and 16B illustrates a combination-use car 221, having rack constructions 247, 247, and trailer hitches and bridges 219, 217. The car is adapted to be loaded or unloaded with trailers 223, 223 at a platform 227 in the same manner as described in the foregoing description — FIGS. 16A. Alternatively, the rack constructions 247 may be manipulated to inactive configurations, the trailer hitches 219 raised, and the trailers 223 supported on the car in conventional manner — FIG. 16B.

Trailer wheel chock arragements 291, 291 of each rack construction 247 are provided and are collapsible for permitting the tractor and trailer wheels to roll over the rack superstructure during car-end loading procedure. Each chock arrangement 291 includes a horizontally pivoted chock member 215, pivotable between a vertically inclined active position and a horizontal inactive position, and catch means 213 for holding the chock member active or releasing the chock member inactive. Selective manipulation of the catch means 213 permits arranging the chock member active when the rack construction is in use — FIG. 16A — or inactive for permitting the trailer wheels to roll over the chock members, when a car is loaded or unloaded by conventional car-end loading procedure.

FIGS. 17–19 illustrate another embodiment of the invention including a railroad car 121 and highway trailer 123. The changes in this embodiment, compared with the embodiment of FIG. 1, chiefly concerns the addition of small-diametered, flanged rollers 165', 165' to the running gear of the trailer (23), and substituting runner rails 199, 199 for the frame and treadway structure (67, 70) of the rack construction (47) of the car (21). The operation of this embodiment is substantially the same as in the first-described embodiment (FIG. 1), and a tractor is used for maneuvering the trailer 123 onto and off the rack construction 147 of the car.

The rollers 165', 165' of the trailer wheel assembly 137 are disposed on the inside of the wheel members 165, 165 of the trailer wheel assembly. The rails 199, 199 of the rack construction 147 define trackway means for the rollers 165', 165'. In the rack construction a bolster 157 supports the runner rails 199, 199 and is turn-supported by a center member 160 on track and carriage structure 159, 161. The runner rails 199, 199 are articulatingly connected by counterweight-link means 181 and a connecting link 192. The distal end portions of the runner rails are angled downward and provided with pads 187, 187; the rearward end portions of the rails are formed generally V-shape, defining detent and chock portions 177, 191 for receiving the rollers 165', 165' of the trailer wheel assembly.

In loading trailer 123 onto car 121, the procedure is the same as in the embodiment, FIG. 1: The rack superstructure is obliquely turned, the trailer maneuvered to alignment with the runner rails 199 and reversed, engaging the rollers 165' with the rails 199, bearing the rails downward, seating the pads 187, 187 on the car deck and platform, and moving the rollers to stopped positions in the V-shaped recesses of the runner rails — FIG. 17. Continuing reverse movement of the tractor-trailer moves the superstructure-carriage 153, 161 rearward to a stopped location, with the tractor and trailer right-angular arranged and the tractor rear wheels supported on the car. The trailer front is lowered and the tractor unhitched and driven onto the platform. The trailer is transportably supported with its forward portion supported on the car deck structure and its rearward portion supported on the rollers 165' riding on the rails 199 of the rack construction of the car. The trailer is unloaded from the car the same as in the first-described embodiment.

While the foregoing description sets forth presently preferred embodiments of the invention, various changes or modifications may be made therein without departing from the basic combination of elements of the invention:

In the foregoing embodiments, the chock and detent members 91 and 77 of the rack construction 47 form the means for controlling movement of the trailer wheel assembly 37 relative to the runner assemblies 55, 55; the trailer wheels being chocked or detent-restrained to the runner assemblies 55, 55 respectively by the members 91 and 77. In a modified embodiment, either or both the members 91, 77 may be dispensed with and the wheel brakes of the trailer wheel assembly 37 applied or released at appropriate times; during the loading/unloading, the braking or releasing of the trailer brakes by the tractor driver provides the means for controlling movement of the wheel assembly relative to the runner assemblies.

In another embodiment, the trailer (23), rather than being in semitrailer form, may be in the form of a full trailer having steerable forward wheels, either permanently secured to the trailer frame or formed by a wheeled dolly separably coupled to the kingpin of a semitrailer — the latter being a trailer configuration typically operated on certain highways in the United States. A full trailer will be loaded/unloaded on and off the rack construction of the railroad car in substantially the same manner as a semitrailer.

The railroad car of the foregoing description is of a configuration for handling and transporting two trailers. While this is presently preferred, it will be understood that the rack construction 47 may as readily be embodied in other types of railroad cars, such as short-length single-trailer cars or articulated cars having multiple trailer-carrying car sections.

What I claim is:

1. In transporting apparatus including a railroad car having frame structure extending lengthwise of the car and highway vehicle means including a semitrailer having load bearing structure and highway wheel means supporting the rearward portion of said load bearing structure, and including a truck-tractor, and means hitching the truck-tractor to said semitrailer; the means for loading the semitrailer onto said car comprising platform means disposed alongside said car, supporting said highway vehicle means, runner means operationally supported on the frame structure of said car, turnable laterally and shiftable longitudinally of the frame structure, means turnably adjusting said runner means laterally of the car frame structure with distal portions thereof disposed contigious said platform means, first means for maneuvering said highway vehicle means, moving said semitrailer backward and said wheel means onto said runner means, means for limiting the movement of said wheel means relative to said runner means, second means for maneuvering said highway vehicle means, maneuvering said truck-tractor backward and progressively angular relative to the semitrailer, actuating said runner means laterally and longitudinally of the car frame structure and moving the forward portion of said semitrailer to a disposition substantially centered transversely of the car, means for transferring the weight of the semitrailer forward portion from said truck-tractor to the frame structure of the car, and means for unhitching and moving the truck-tractor onto the platform means.

2. Transporting apparatus as defined in claim 1 wherein said runner means includes treadway means adapted to engage and support the wheel means of the semitrailer, said first means for maneuvering said highway vehicle means, moving said semitrailer backward and said wheel means onto said treadway means.

3. Transporting apparatus as defined in claim 1 wherein said highway wheel means of said semitrailer includes a wheeled axle having highway wheels supporting opposite sides of said load bearing structure, and additionally includes roller means disposed inward of said wheels, and wherein said runner means includes a pair of rails operationally supported on the frame structure of said car, turnable laterally and shiftable longitudinally of said frame structure, and includes means for guiding said roller means on said rails upon backward movement of said wheel means onto said runner means.

4. In transporting apparatus including a railroad car having frame structure extending lengthwise of the car, and highway vehicle means including a semitrailer having load bearing structure and highway wheel means supporting the rearward portion of said load bearing structure, and including a truck-tractor and means hitching said truck-tractor to said semitrailer; the means for loading said semitrailer on said car, comprising platform means disposed alongside said car, supporting said highway vehicle means, a rack construction supported on said frame structure, having forward direction, adapted for handling, and supporting in rail transit, the semitrailer rearward portion, said rack construction including a pair of runner assemblies, each assembly including a treadway, providing a pair of treadways adapted to support the wheel means of said semitrailer, a carriage supported on and guidingly constrained in shifting movement longitudinally of the car frame structure, a bolster, means turnably supporting said bolster on said carriage, means operationally supporting said pair of treadways on said bolster, permitting vertically orientated movement individually, one treadway relative to the other treadway, means turnably adjusting said runner assemblies to a disposition oblique of said car frame structure and with distal portions thereof disposed contigious said platform means, first means for maneuvering said highway vehicle means, moving said semitrailer backward and the wheel means thereof onto the pair of runner assemblies, means for limiting the movement of said wheel means relative to said runner assemblies, second means for maneuvering said highway vehicle means, maneuvering said truck-tractor backward and progressively angular relative to said semitrailer, turning and shiftingly actuating said runner assemblies rearwardly and moving the forward portion of said semitrailer to a disposition substantially centered transversly of the car, means for transferring the weight of the semitrailer forward portion from said truck-tractor to the frame structure of said car, and means for unhitching and moving said truck-tractor onto said platform means.

5. Transporting apparatus as defined in claim 4 wherein said highway wheel means of said semitrailer includes a forward wheeled axle and a rearward wheeled axle, wherein the treadway of each runner assembly extends forward of said bolster, with the rearward end thereof disposed contigious said bolster and at a level substantially below the level of the upper margin of the bolster, wherein each runner assembly includes a wheel seat disposed directly rearward of the bolster and at a level substantially below the level of the upper margin of said bolster and providing a pair of wheel seats, the semitrailer wheel means being adapted to be supported on said pair of runner assemblies with said forward wheeled axle seating on the rearward ends of said pair of treadways and said rearward wheeled axle seating on the pair of wheel seats.

6. Transporting apparatus as defined in claim 4 wherein the railroad car includes deck means disposed adjacent said rack construction, wherein each runner assembly includes elongate frame means, means tiltably supporting said frame means on said bolster in a configuration providing a substantial reach of said frame means forward of said bolster, means mounting said treadway on said frame means forward of said bolster, the pair of treadways being adapted to receive the semitrailer wheel means, bearing the treadways and frame means downward, pad means subjacently supported on said frame means of each assembly, disposed a substantial distance forward of said bolster, the pad means of one runner assembly and the other runner assembly being adapted to simultaneously seat on the car deck means and platform means, means yieldably urging said frame means upward, and means for stopping the upward movement of said frame means at a disposition cantilever supporting said runner assemblies on said bolster.

7. Transporting apparatus as defined in claim 6 wherein each runner assembly includes means loosely connecting said frame means and treadway, permitting torsional flexibility lengthwise of each runner assembly, responsive to movement of the semitrailer wheel means on each assembly.

8. Transporting apparatus as defined in claim 6 wherein the frame means of each runner assembly is tiltably supported superjacently on said bolster, extending forwardly and rearwardly therefrom, and wherein said means yieldably urging said frame means upward is in the form of counterweight structure supported on said frame means rearward of said bolster, offsetting the weight of the runner assembly structure disposed forward of said bolster.

9. Transporting apparatus as defined in claim 6 wherein the frame means of each runner assembly includes a parallel pair of frame members supported on and extending forward of said bolster, wherein each treadway includes a forward extension and a rearward extension, each of integral, individual form, and including first pivot means endwise pivotally joining the forward and rearward extensions, second pivot means pivotally mounting said treadway on and between said frame members, means yieldably pivoting the treadway rearward extension downward, means for stopping the downward movement of said rearward extension, disposing the rearward end portion thereof contigious said bolster, and check means based from said rearward extension, positioning said forward extension against gravity, disposing the forward end of said extension contigious said platform means when said runner assemblies are obliquely turned.

* * * * *